US007819491B2

(12) United States Patent
Nishimura

(10) Patent No.: US 7,819,491 B2
(45) Date of Patent: Oct. 26, 2010

(54) INK JET HEAD DRIVER

(75) Inventor: Asayo Nishimura, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 559 days.

(21) Appl. No.: 11/984,647

(22) Filed: Nov. 20, 2007

(65) Prior Publication Data

US 2008/0117245 A1 May 22, 2008

(30) Foreign Application Priority Data

Nov. 21, 2006 (JP) ..... 2006-314472

(51) Int. Cl.
*B41J 29/38* (2006.01)

(52) U.S. Cl. ..... 347/9; 347/10; 347/11; 347/14

(58) Field of Classification Search ..... 347/9–14
See application file for complete search history.

(56) References Cited

U.S. PATENT DOCUMENTS 6,386,664 B1 * 5/2002 Hosono et al. ..... 347/9

FOREIGN PATENT DOCUMENTS

JP 11314360 A * 11/1999

* cited by examiner

*Primary Examiner*—Julian D Huffman
*Assistant Examiner*—Jason S Uhlenhake
(74) *Attorney, Agent, or Firm*—Manabu Kanesaka

(57) ABSTRACT

An ink jet head driver including a control section that calculates a first head passing time required for the paper sheet from the leading edge to the tailing edge to pass the ink jet head, drives the piezoelectric element of the ink jet head for a predetermined time to perform precursor microvibration immediately before a leading edge of the paper sheet reaches right under the ink jet head and then drives the piezoelectric element according to the normal pixel data to form the image on the paper sheet when the first head passing time is under the deterioration time of the ink, and drives the piezoelectric element of the ink jet head for a predetermined time to perform precursor microvibration immediately before the leading edge of the paper sheet reaches right under the ink jet head.

6 Claims, 13 Drawing Sheets

Fig.3

| USER SETTING | | | | | | PRESENCE OF PRECURSOR B |
|---|---|---|---|---|---|---|
| ONE-SIDED/ TWO-SIDED | PRINT MODE | PAPER TYPE | PAPER SIZE | TRANSPORT SPEED | HEAD PASSING TIME | |
| ONE-SIDED PRINTING | NORMAL MODE | IJ PAPER | A3 (VERTICAL) | 400 mm/s | 1.05s | YES |
| | | | A4 (VERTICAL) | | 0.735s | YES WHEN 35°C OR HIGHER |
| | | | A4 (HORIZONTAL) | | 0.525s | YES WHEN 35°C OR HIGHER |
| | | STANDARD PAPER | A3 (VERTICAL) | 600 mm/s | 0.7s | YES WHEN 35°C OR HIGHER |
| | | | A4 (VERTICAL) | | 0.49s | NO |
| | | | A4 (HORIZONTAL) | | 0.35s | NO |
| | HIGH-PRECISION MODE | IJ PAPER | A3 (VERTICAL) | 200 mm/s | 2.1s | YES |
| | | | A4 (VERTICAL) | | 1.47s | YES |
| | | | A4 (HORIZONTAL) | | 1.05s | YES |
| | | STANDARD PAPER | A3 (VERTICAL) | 300 mm/s | 1.4s | YES |
| | | | A4 (VERTICAL) | | 0.98s | YES WHEN 35°C OR HIGHER |
| | | | A4 (HORIZONTAL) | | 0.7s | YES WHEN 35°C OR HIGHER |
| TWO-SIDED PRINTING | NORMAL MODE | IJ PAPER | A3 (VERTICAL) | 320 mm/s | 1.31s | YES |
| | | | A4 (VERTICAL) | | 0.92s | YES WHEN 35°C OR HIGHER |
| | | | A4 (HORIZONTAL) | | 0.656s | YES WHEN 35°C OR HIGHER |
| | | STANDARD PAPER | A3 (VERTICAL) | 480 mm/s | 0.875s | YES WHEN 35°C OR HIGHER |
| | | | A4 (VERTICAL) | | 0.613s | YES WHEN 35°C OR HIGHER |
| | | | A4 (HORIZONTAL) | | 0.438s | NO |
| | HIGH-PRECISION MODE | IJ PAPER | A3 (VERTICAL) | 160 mm/s | 2.63s | YES |
| | | | A4 (VERTICAL) | | 1.84s | YES |
| | | | A4 (HORIZONTAL) | | 1.32s | YES |
| | | STANDARD PAPER | A3 (VERTICAL) | 240 mm/s | 1.75s | YES |
| | | | A4 (VERTICAL) | | 1.23s | YES |
| | | | A4 (HORIZONTAL) | | 0.875s | YES WHEN 35°C OR HIGHER |

INK JET HEAD DRIVER

BACKGROUND OF THE INVENTION

1. Field of the Invention

This invention relates to a device for driving an ink jet head for applying an electric field in the vertical direction to the polarizing direction to a piezoelectric element to cause displacement of a shear mode, and pressurizing the ink by this displacement to discharge ink selectively from plural nozzles and form an image on a paper sheet and particularly to the ink jet head driver, which may effectively perform precursor microvibration (the operation of previously vibrating meniscus of ink to such an extent not to discharge ink from the nozzles) to improve intermittent discharge performance in the ink jet head.

2. Description of Related Art

One structural example of a shear-mode ink jet head will be described. As disclosed in the patent document 1 mentioned later, in a two-layer planar structure where two piezoelectric elements polarized in the opposite directions to each other with respect to the direction of board thickness are bonded by an adhesive, the adhesive surfaces of the piezoelectric elements are cut from one surface of the piezoelectric element so that a number of grooves at fixed intervals pass, the tip parts of the respective grooves are opened at the plate to form a comb-like structure, the top sides of these grooves being closed by another plate. The rear ends of the grooves are communicated with a common ink chamber, the openings at the tip parts are provided with an orifice plate having a nozzle in a position of each groove, and an electrode is provided on the inner surface of the groove.

In the above construction, when an electric field in the vertical direction to the polarizing direction of the electrode is applied to the piezoelectric elements, displacement of the shear-mode is cased in the piezoelectric member, and the ink in the grooves is pressurized by this displacement so that ink drops are discharged from the selected nozzles.

In an image forming apparatus using the thus constructed ink jet head, generally the ink jet head is fixedly provided in a predetermined position so that a plurality of nozzles are arranged in the direction orthogonal to the transport direction of a paper sheet, the paper sheet is transported thereto by a transport mechanism, and in synchronization with the transport of the paper sheet, the ink jet head is driven in a suitable timing, thereby making a discharged ink drop to the paper sheet to form a desired image. Concerning the respective pixels constituting an image to be formed, the maximum of drops to be discharged is predetermined, and the ink drops of a number required by each pixel corresponding to the size of the concerned pixel within the range are discharged.

In the above shear-mode ink jet head, as shown in the following patent document 2, in some case, precursor microvibration is performed in order to improve the intermittent discharge performance of ink drops, and in that case, it is effective to perform the precursor microvibration immediately before image formation.

In the image formation using the shear-mode ink jet head, as to what is the timing of performing precursor microvibration, according to the prior art, mostly in the image formation process conducted by driving the ink jet head while the paper sheet is transported to the ink jet head, the precursor microvibration is performed for all of the nozzles outside of the image formation range of the paper sheet, and even for the nozzles within the image formation range of the paper sheet, that actually do not discharge ink drops for image formation, the precursor microvibration is always performed.

[Patent Document 1] Japanese Publication Number of Unexamined Application: 2000-135787

[Patent Document 2] Japanese Publication Number of Unexamined Application: 2004-230775

In the image forming apparatus using the above shear-mode ink jet head, however, since the head is fixed and the paper sheet is transported as described above, even if the precursor microvibration is performed for all of nozzles immediately before image formation, with the nozzle adapted to discharge a small dot only to the tailing end of the paper sheet, when the small dot is formed into an image after the precursor vibration is performed, several seconds have already elapsed after the latest precursor microvibration in some case depending on the paper size and the paper transport speed. In that case, discharge failure is caused.

In the nozzle which discharges ink drops of a number under the maximum of discharged drops, when the precursor microvibration is always performed in the timing of non-discharge, there is a fear of a temperature rise of the head.

SUMMARY OF THE INVENTION

In view of the above problems, the invention provides an ink jet head driver, which may effectively perform precursor microvibration without a temperature rise of a head.

According to an aspect of the present invention, an ink jet head driver, which is adapted to discharge ink drops of a number predetermined taking the maximum of discharged drops as a limit by each pixel data piece corresponding to plural pixels for constituting an image to a transported paper sheet at desired timing to form the image on the paper sheet in driving an ink jet head including a piezoelectric element for pressurizing ink by displacement of a shear mode and plural nozzles from which the ink is selectively discharged, is characterized in that the ink jet head driver includes a control section that calculates a first head passing time required for the paper sheet from the leading edge to the tailing edge to pass the ink jet head, drives the piezoelectric element of the ink jet head for a predetermined time to perform precursor microvibration immediately before a leading edge of the paper sheet reaches right under the ink jet head and then drives the piezoelectric element according to the normal pixel data to form the image on the paper sheet when the first head passing time is under the deterioration time of the ink, and drives the piezoelectric element of the ink jet head for a predetermined time to perform precursor microvibration immediately before the leading edge of the paper sheet reaches right under the ink jet head and then drives the piezoelectric element according to the pixel data to which the data for driving the piezoelectric element not to discharge ink as many times as a difference between the maximum of discharged drops and the number of ink drops to be discharged is added concerning the pixel in which the number of ink drops to be discharged is under the maximum of discharged drops to form the image on the paper sheet when the first head passing time is equal to or longer than the deterioration time of the ink.

According to another aspect of the present invention, the above ink jet head driver is characterized in that the control section calculates an image formation start time required for the paper sheet from the leading edge to the image formation start position to pass the ink jet head, drives the piezoelectric element of the ink jet head to perform precursor microvibration for a predetermined time immediately before the leading edge of the paper sheet reaches right under the ink jet head and then drives the piezoelectric element according to the normal pixel data to form the image on the paper sheet when the image formation start time is under the deterioration time of the ink, calculates a second head passing time required for the paper sheet from the image formation start position to the tailing edge to pass the ink jet head when the image formation start time is equal to or longer than the deterioration time of the ink, drives the piezoelectric element of the ink jet head for a predetermined time to perform precursor microvibration immediately before the image formation position start position of the paper sheet reaches right under the ink jet head and then drives the piezoelectric element according to the normal pixel data to form the image on the paper sheet when the second head passing time is shorter than the deterioration time of the ink, and drives the piezoelectric element of the ink jet head for a predetermined time to perform precursor microvibration immediately before the image formation start position of the paper sheet reaches right under the ink jet head and then drives the piezoelectric element according to the pixel data to which the data for driving the piezoelectric element not to discharge ink as many times as a difference between the maximum number of discharge drops and the number of ink drops to be discharged is added concerning the pixel in which the number of ink drops to be discharged is under the maximum of discharged drops to form the image on the paper sheet when the second head passing time is equal to or longer than the deterioration time of the ink.

According to another aspect of the present invention, an ink jet head driver, which is adapted to discharge ink drops of a number predetermined taking the maximum of discharged drops as a limit by each pixel data piece corresponding to plural pixels for constituting an image to a transported paper sheet at desired timing to form the image on the paper sheet in driving an ink jet head including a piezoelectric element for pressurizing ink by displacement of a shear mode and plural nozzles from which the ink is selectively discharged, is characterized in that the ink jet head driver includes a control section that calculates a second head passing time required for the paper sheet from the image formation start position to the tailing edge to pass the ink jet head, drives the piezoelectric element of the ink jet head for a predetermined time to perform precursor microvibration immediately before the image formation start position of the paper sheet reaches right under the ink jet head and then drives the piezoelectric element according to the normal pixel data to form the image on the paper sheet when the second head passing time is under the deterioration time of the ink, and drives the piezoelectric element of the ink jet head for a predetermined time to perform precursor microvibration immediately before the image formation start position of the paper sheet reaches right under the ink jet head and then drives the piezoelectric element according to the pixel data to which the data for driving the piezoelectric element not to discharge ink as many times as a difference between the maximum of discharged drops and the number of ink drops to be discharged is added concerning the pixel in which the number of ink drops to be discharged is under the maximum of discharged drops to form the image on the paper sheet when the second head passing time is equal to or longer than the deterioration time of the ink.

According to another aspect of the present invention, one of the ink jet head drivers described above includes a temperature detecting section that detects the temperature of the ink jet head, wherein the control section changes the deterioration time of the ink according to the temperature of the ink jet head detected by the temperature detecting section.

According to another aspect of the present invention, the ink jet head driver is characterized in that in the ink jet head driver described above, the first head passing time is determined by plural setting conditions including at least the size of the paper sheet and the transport speed of the paper sheet.

According to another aspect of the present invention, the ink jet head driver is characterized in that in the ink jet head driver described above, the second head passing time is determined by plural setting conditions including at least the size of the paper sheet and the transport speed of the paper sheet.

In the above respective solving means, the control section is capable of calculating the first head passing time and the second head passing time by the paper size detecting section and the transport speed of the paper sheet, and as the paper size detecting section, the size of a paper sheet may be detected by a sensor provided on a paper feed table, or the size of a paper sheet may be detected by a paper detecting sensor provided in the midway of a paper transport passage and the transport speed of a paper sheet. Further, the paper size data itself input from an input section such as a console panel may be used. The image formation start time may be calculated by a size detecting section for a paper sheet, the transport speed of the paper sheet and image data including data showing which position of the paper sheet the image formation is started in.

In the ink jet head driver according to an aspect of the present invention, it will be apparent that the time required for the paper sheet to pass the ink jet head is calculated, and the length of the time and the ink deterioration time are compared, whereby precursor microvibration may be performed only at necessary timing so that a temperature rise of the head is not caused, and improvement in intermittent discharge performance by precursor microvibration may be surely attained.

In the ink jet head driver according to another aspect of the present invention, it will be apparent that in the advantage of the above ink jet head driver, in the case of printing without an image formation area at the leading edge side of a paper sheet and with an image formation area at the tailing edge side, the image formation start time required for the paper sheet from the leading edge to the image formation start position to pass the ink jet head is calculated, the length of time and the ink deterioration time are compared, whereby precursor microvibration may be performed only at necessary timing so that a temperature rise of the head is not caused, and improvement in intermittent discharge performance by precursor microvibration may be surely attained.

In the ink jet head driver according to another aspect of the present invention, it will be apparent that in the case of printing without an image formation area at the leading edge side of a paper sheet and with an image formation area at the tailing edge side, the image formation start time required for the paper sheet from the leading edge to the image formation start position to pass the ink jet head is calculated, the calculated time and the ink deterioration time are compared, whereby precursor microvibration may be performed only in the timing of necessity so that a temperature rise of the head is not caused, and improvement in intermittent discharge performance by precursor microvibration may be surely attained.

In the ink jet head driver according to another aspect of the present invention, it will be apparent that in the advantages of one of the above ink jet head drivers, it may suitably cope with a phenomenon that the higher the temperature of the head and its periphery is, the shorter the ink deterioration time is, so that even in an environment where the temperature is apt to change, improvement in intermittent discharge performance by precursor microvibration may be surely attained.

In the ink jet head driver according to another aspect of the present invention, it will be apparent that in the advantages of the above ink jet head driver, the first head passing time, to which the timing of performing precursor microvibration is referred, may be suitably determined by the setting conditions including at least the size of the paper sheet and the transport speed of the paper sheet.

In the ink jet head driver according to another aspect of the present invention, it will be apparent that in the advantages of the above ink jet head driver, the second head passing time to, which the timing of performing precursor microvibration is referred, may be suitably determined by the setting conditions including at least the size of the paper sheet and the transport speed of the paper sheet.

BRIEF DESCRIPTION OF THE DRAWINGS

FIG. 3 shows data in a table format, which shows the correspondence relationship of various data used in the ink jet head driver according to the embodiment of the invention;

DETAILED DESCRIPTION OF THE PREFERRED EMBODIMENTS

An ink jet head driver according to the embodiment of the invention will be described in detail with reference to the drawings.

1. First Embodiment

First Example, See FIGS. 1 to 8

Figure 1:
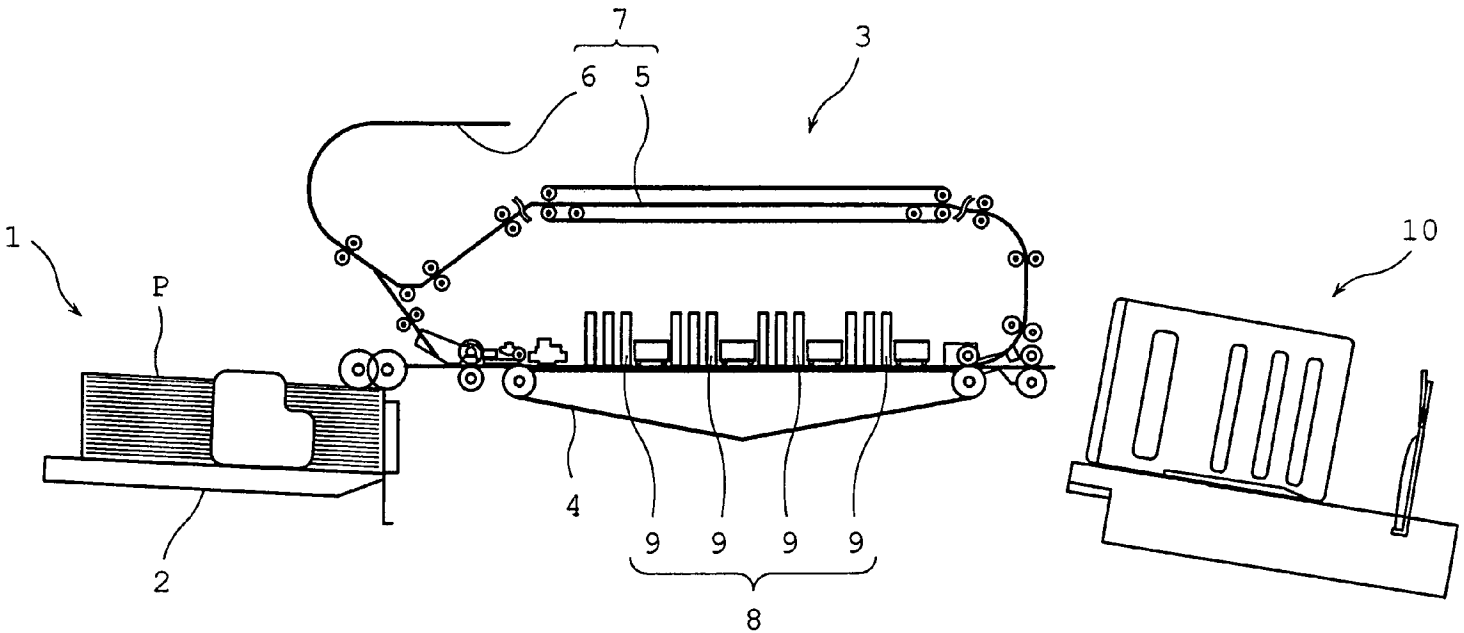
FIG. 1 is a general block diagram of an image forming apparatus, seen from the side view side according to an embodiment of the invention.

FIG. 1 is a general block diagram of an image forming apparatus for color printing, seen from the side view side according to the first example using a shear mode type ink jet head, and an ink jet head driver of the image forming apparatus causes the ink jet head to perform the image forming operation including precursor microvibration, thereby forming an image on a paper sheet. In the specification and the drawings of this application, "printing" as the printing operation by the image forming apparatus means wide printing operation including the graphics and the other images as well as letters, and in that respect, it has the same meaning as "image" including "image formation".

In FIG. 1, paper sheets P are loaded on an elevating paper feed table 2 of a paper supply station 1, and fed sheet by sheet into a paper transport station 3 at the next stage. The paper transport station 3 includes: a transport belt 4 for transporting the paper sheet P backward horizontally; and a paper transport path 7 having a loop-like circulating route part 5 connecting the rear end and front end of the transport belt 4 with each other and a reversing route part 6 connected thereto for reversing the front and back of the paper sheet P in the case of both-sided printing. Although the detailed description and illustration are omitted, the paper transport path 7 is constructed by a pair of guide plates disposed opposite to each other at a predetermined space, a transport roller and a transport belt for forwarding the paper sheet between the guide plates and so on.

Plural ink jet heads 9 of a shear mode type constituting a printing part 8 are disposed respectively upside down at predetermined spaces adjacent to the upside of the transport belt 4. Each of the ink jet heads 9 is a linear print head, which is respectively provided with plural nozzles arranged in the direction orthogonal to the transport direction of the paper sheet, and the respective ink jet heads 9 are adapted to discharge ink of the respective colors of cyan, magenta, yellow and black. In the first embodiment, it is supposed to use water ink, which has a comparatively short deterioration time due to evaporation of water so that it is important to perform precursor microvibration.

At the subsequent stage of the transport belt 4, a paper delivery station 10 is provided to sequentially receive the printed paper sheets P and loaded with the paper sheets. In addition to the above, not shown in FIG. 1, the image forming apparatus includes a control section for supervising and controlling the whole apparatus, and particularly a part of the section functions as a control part for driving the ink jet heads as a control section.

Figure 2:
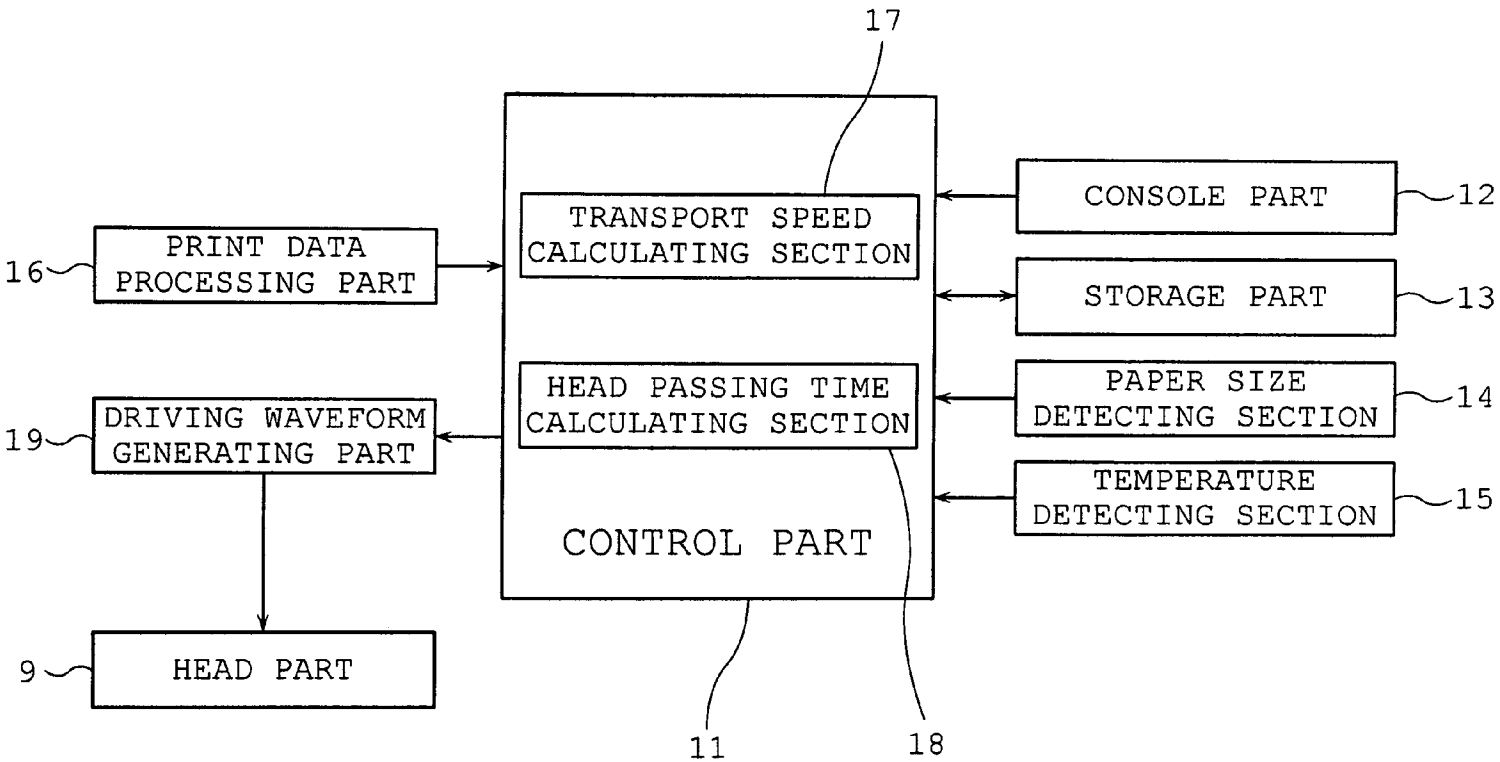
FIG. 2 is a block diagram showing the configuration of an ink jet head driver according to an embodiment of the invention.

FIG. 2 shows the structure of a control part 11 as the control section and its periphery in the first embodiment. A console panel 12 is a device for performing various settings concerning the image formation and inputting the information and instructions necessary for the image formation to the control part 11. A storage part 13 stores various data and control programs necessary for the image formation, and supplies the same for the control part 11 at need. A paper size detecting section 14 detects the size of a paper sheet supplied for the image formation, and outputs a paper size detection signal to the control part 11. A temperature detecting section 15 detects the temperature of the ink jet heads 9 or the temperature of its periphery which affects the property of ink, and outputs a temperature signal to the control part 11.

A print data processing part (an image data processing part) 16 is a device for transporting the image data read from an original document by a scanner not shown and the other image data transmitted from the other devices to the image data suitable for the image formation using the ink jet heads 9 of the present embodiment. In the device, for example, the image data of the respective pixels constituting an image is processed to be represented by the number of ink drops discharged by the respective ink jet heads 9, and in this case, for example, supposing that the maximum discharge drop number is five drops, the drop number of ink drops discharged may be determined in the range of 0 to five drops.

The control part 11 includes a transport speed calculating section 17, which calculates the transport speed of the paper sheet P using input from the console panel 12, read of data and program from the storage part 13, a paper size detection signal from the paper size detecting section 14, and a temperature detection signal from the temperature detecting section 15.

The calculation of the speed may be operated at every time, or as shown in FIG. 3, it may be referred to the data of a table format predetermined according to the relationship to various data.

Further, the control part 11 includes a head passing time calculating section 18, which calculates the passing time of the paper sheet P to the ink jet heads 9 according to the data from the respective parts described above. The head passing time calculating section 18 may calculate a first head passing time required for the paper sheet P from the leading edge to the tailing edge to pass the ink jet heads and a second head passing time required for the paper sheet P from the image formation start position to the tailing edge to pass the ink jet heads 9 especially in the case where an image is formed only at the tailing edge side of the paper sheet P according to a control mode, and further calculate the image formation start time required for the paper sheet P from the leading edge to the image formation start position to pass the ink jet heads 9 as well.

The first and second head passing times may be computed by the paper size detecting section 14 and the transport speed of the paper sheet P each time, or as shown in FIG. 3, it may be obtained with reference to the data of a table format in which the head passing time and the presence/absence of precursor microvibration are predetermined in relationship to the contents of various settings including given data and the head passing time.

The image formation start time may be calculated by the paper size detecting section 14, the transport speed of the paper sheet P and image data including data showing at which position on the paper sheet P the image formation is started.

As to the paper size detecting section 14 used in the case of computing the above head passing times and the image formation start time by the control part 11, the size of the paper sheet P may be detected by a sensor provided on the paper feed table 2, or the size of the paper sheet P may be detected by a paper detecting sensor disposed in the route of the paper transport station 3 and the transport speed of the paper sheet P. Further the paper size data itself input from an input section such as the console panel 12 may be used.

The control part 11 controls a driving waveform generating part 19 by the calculated paper transport speed, the time data such as the head passing time and the image data to generate a required driving waveform, and supplies the waveform to the ink jet heads 9 (the head part 9 in FIG. 1), thereby performing ink discharge operation including precursor microvibration performed timely.

Needless to say, the above ink discharge operation is performed in time to the transport operation for the paper sheet P using the transport belt 4, and another part not shown of the control part 11 or another separately provided control section takes charge of the transport control for the paper sheet P.

The characteristics of control and operation for the ink jet heads 9 in the first embodiment will now be schematically described with reference to FIG. 4 and FIG. 5, and subsequently the details of control will be described with reference to FIG. 6 to FIG. 8.

Figure 4A:
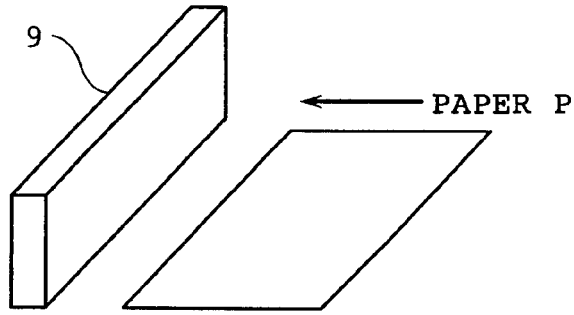
FIG. 4 is a typical diagram showing the operation of an ink jet head in a first embodiment.
Figure 4B:
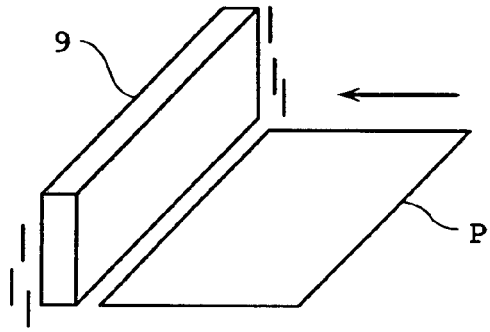
Figure 4C:
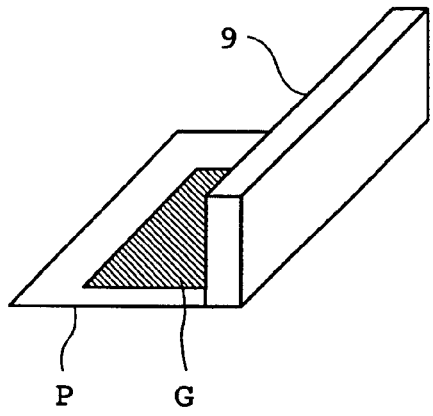

FIG. 4 shows the case in which the paper sheet P is A4-sized and fed in the lateral direction, and the transport speed is 400 mm/s, and in the case, since the length in the transport direction (indicated by an arrow in the drawing) is short, time spent when the printing range passes the ink jet heads 9 is short, so that it does not exceed the ink deterioration time. In this case, as shown in FIG. 4A, the transport speed of the paper sheet P and the length in the transport direction are detected, and as shown in FIG. 4B, precursor microvibration is performed in the timing immediately before the leading edge of the transported paper sheet P reaches right under the ink jet head 9. After that, as shown in FIG. 4C, printing (formation of an image G) is performed in the normal waveform without causing unnecessary precursor microvibration and without causing extra heat generation in the ink jet head 9.

Figure 5A:
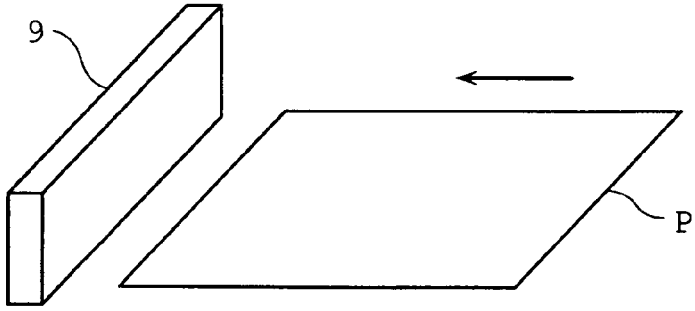
FIG. 5 is a typical diagram showing the operation of an ink jet heat in the first embodiment.
Figure 5B:
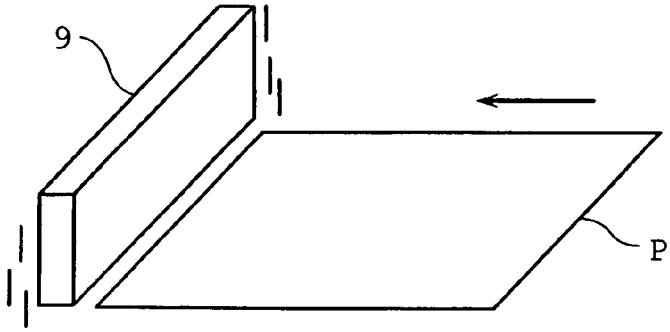
Figure 5C:
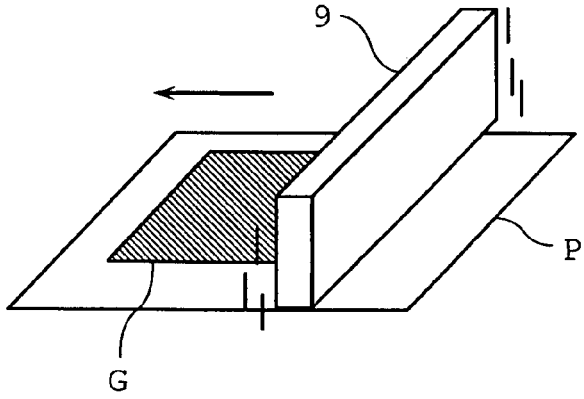
Figure 6:
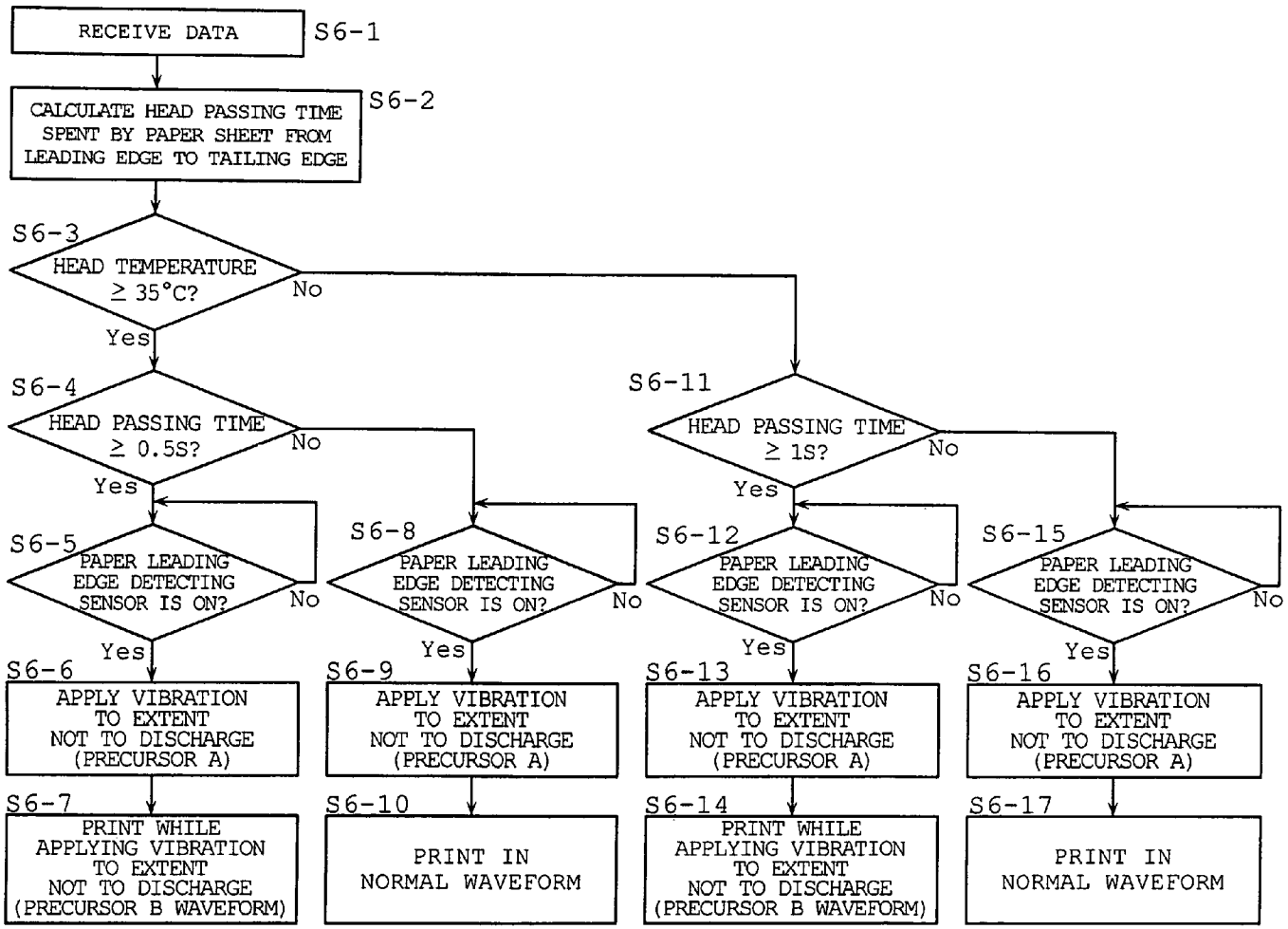
FIG. 6 is a flowchart showing the driving procedure of the ink jet head in the first embodiment.

FIG. 5 shows the case in which the paper sheet P is A3-sized and fed in the longitudinal direction, and the transport speed is 400 mm/s, and in the case, since the length in the transport direction (indicated by an arrow in the drawing) is long, time spent when the printing range passes the ink jet heads 9 is long, so that it exceeds the ink deterioration time in the process of printing. In this case, as shown in FIG. 5A, the transport speed of the paper sheet P and the length in the transport direction are detected, and as shown in FIG. 5B, precursor microvibration is performed in the timing immediately before the leading edge of the transported paper sheet P reaches right under the ink jet head 9. After that, as shown in FIG. 5C, while ink is discharged pixel by pixel to form an image G, precursor microvibration is performed in the timing of not discharging an ink drop. That is, in the case where the number of ink drops discharged for each pixel is under 5, which is the maximum of discharged drops, the piezoelectric element is driven according to the pixel data to which the data for driving the piezoelectric element not to discharge ink as many times as a difference between five and the drop number of actually discharged ink drops is added, and with the image formation, the precursor microvibration is performed as well.

The control of the ink jet head 9 by the control part 11 of the first embodiment will now be described with reference to the flowchart of FIG. 6.

The control part 11 starts the control on receiving various data such as input from the console panel 12, read of the data and program from the storage part 13, a paper size detection signal from the paper size detecting section 14, and a temperature signal from the temperature detecting section 15 (S6-1), and calculates the first head passing time required for the paper sheet P from the leading edge to the tailing edge to pass the ink jet head 9 (S6-2).

The control part 11 determines whether or not the head temperature is 35° C. or higher (S6-3), and if it is 35° C. or higher (S6-3, YES), the ink deterioration time, which is the reference for determining whether or not the ink deteriorates, is set to 0.5 sec, and it is determined whether or not the calculated first head passing time is 0.5 sec or more (S6-4). When the calculated first head passing time is 0.5 sec or more (S6-4, YES) and there is a fear of ink deterioration, the leading edge of the paper sheet P is detected by a sensor not shown (S6-5, YES), and precursor microvibration is performed in the timing immediately before the leading edge of the transported paper sheet P reaches right under the head (S6-6, called "precursor A"). Subsequently, while ink is discharged pixel by pixel to form an image, in the case where the drop number of ink drops discharged in each pixel is under five, which is the maximum of discharged drops, the piezoelectric element is driven according to the pixel data to which the data for driving the piezoelectric element not to discharge ink as many times as a difference between five and the drop number of actually discharged ink drops is added, and with the image formation, the precursor microvibration is performed as well (S6-7, called "precursor B").

When the calculated first head passing time is under 0.5 (S6-4, NO) and there is no fear of ink deterioration, the leading edge of the paper sheet P is detected by the sensor not shown (S6-8, YES), and the precursor A is performed in the timing immediately before the leading edge of the transported paper sheet P reaches right under the head. After that, printing (image formation) is performed in a normal waveform without performing unnecessary precursor microvibration and without causing extra heat generation in the head (S6-10).

When the head temperature is under 35° C. (S6-3, NO), the ink deterioration time, which is the reference for determining whether or not ink deteriorates, is set longer to one second, and it is determined whether or not the calculated first head passing time is one second or more (S6-11). In the case where the calculated first head passing time is one second or more (S6-11, YES), and there is a fear of ink deterioration, when the leading edge of the paper sheet P is detected by the sensor not shown (S6-12, YES), the precursor A is performed in the timing immediately before the leading edge of the transported paper sheet P reaches right under the head (S6-13). Subsequently, while ink is discharged pixel by pixel to form an image, in the case where the drop number of ink drops discharged in each pixel is under five, which is the maximum of discharged drops, the piezoelectric element is driven according to the pixel data to which the data for driving the piezoelectric element not to discharge ink as many times as a difference between five and the drop number of actually discharged ink drops is added, and with the image formation, the precursor B is performed as well (S6-14).

In the case where the calculated first head passing time is under one second (S6-11, NO), and there is no fear of ink deterioration, when the leading edge of the transported paper sheet P is detected by the sensor not shown (S6-15, YES), the precursor A is performed in the timing immediately before the leading edge of the transported paper sheet P reaches right under the head (S6-16). After that, printing (image formation) is performed in a normal wave form without performing unnecessary precursor microvibration and without causing extra heat generation in the head (S6-17).

Figure 7:
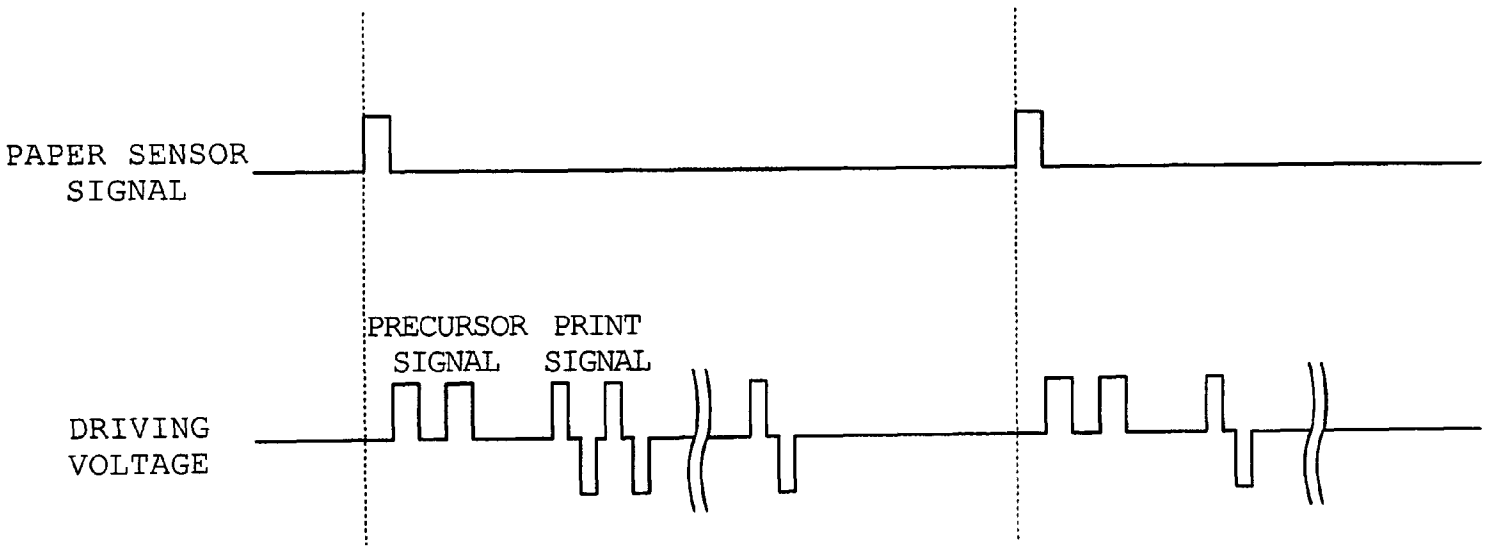
FIG. 7 is an example of a driving waveform chart of the ink jet head in the first embodiment.
Figure 8:
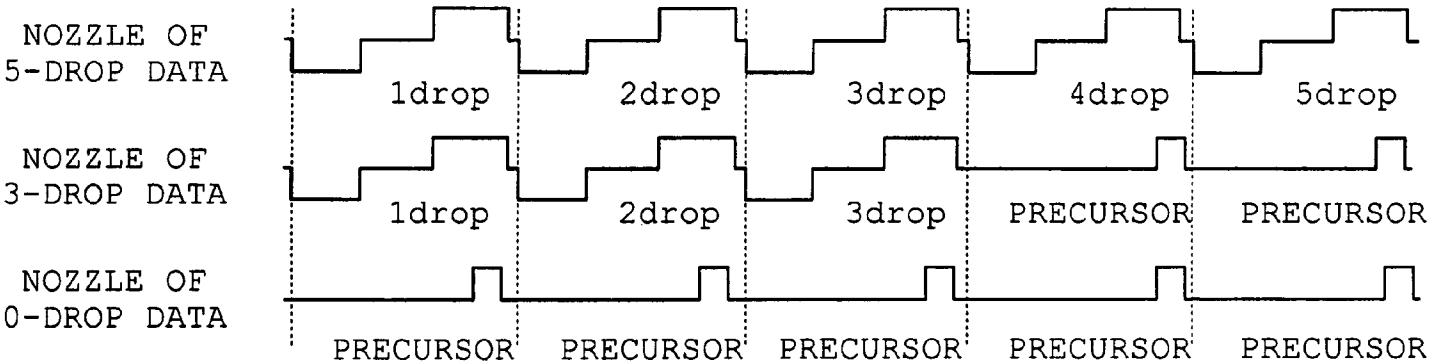
FIG. 8 is an example of a waveform chart showing an image formation signal (a print signal) corresponding to three kinds of ink drop discharge numbers in the driving waveform chart of the ink jet head according to the first embodiment.

FIG. 7 is a waveform chart of a timing signal in the case where the leading edge of the paper sheet P is detected, the precursor A is performed, and after that, printing (image formation) is performed according to a print signal under the above control in the first embodiment. Although the print signal (image signal) includes the precursor B in some case, and it does not so in some case, the precursor B is, as shown in FIG. 8, performed for the nozzle, which discharges ink having a number of ink drops under the maximum of ink drops corresponding to one pixel. That is, although in formation of each pixel, the ink drops having the maximum of five may be discharged for a desired number of drops, in the case where the head passing time is longer than the ink deterioration time so that the precursor B is needed to be performed even in the process of image formation, in FIG. 8, in the nozzle (3-drop data nozzle) adapted to discharge three ink drops for image formation of the concerned pixel, the precursor B is performed twice, and in the nozzle (0-drop data nozzle) which does not form a pixel, the precursor B is performed five times. Thus, the precursor B is performed at the timing of not discharging any ink drop within the image formation timing of each pixel.

2. Second Embodiment

Second Example, See FIGS. 9 to 12

The characteristics of the control and operation of an ink jet head 9 in a second embodiment will now be schematically described with reference to FIG. 9, and subsequently the details of the control will be described with reference to FIGS. 10 to 12. Except the control contents, the configuration of the devices are substantially the same as that of the first embodiment.

Figure 9:
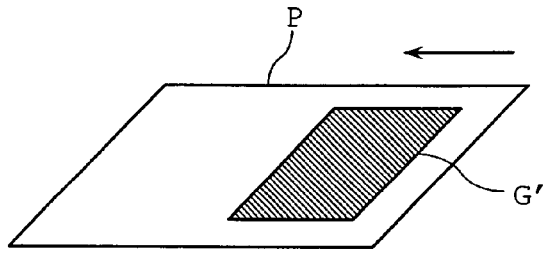
FIG. 9 is a typical diagram showing the operation of an ink jet head in the second and third embodiments.
Figure 9:
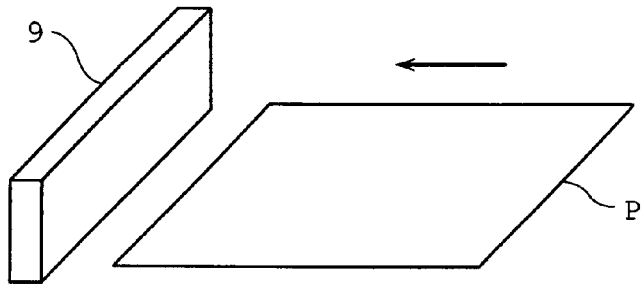
Figure 9:
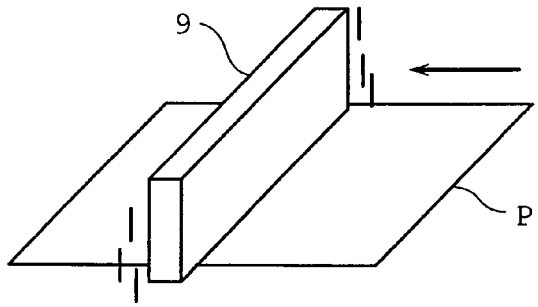

FIG. 9 shows the case in which an image G is formed only in the rear part in the transport direction of a paper sheet P (indicated by an arrow in the drawing) (the leading end of image data is located in the rear of the paper sheet P), that is, the case of printing an original document in which the leading end side of the paper sheet P is a blank space. In this case, a long time takes for passing of the blank space at the leading end side of the paper sheet P where printing is not performed, so whether or not precursor microvibration is needed becomes a problem immediately before the start of printing.

In this case, as shown in FIG. 9A, the position of the leading end of an image G' to be formed on the paper sheet P (the image formation start position) is detected, and as shown in FIG. 9B, precursor microvibration is not performed at the leading edge of the paper sheet P. After that, as shown FIG. 9C, the precursor microvibration is performed immediately before the image formation start position.

The control of an ink jet head 9 by a control part 11 in the second embodiment will now be described with reference to the flowcharts shown in FIGS. 10 to 12.

Figure 10:
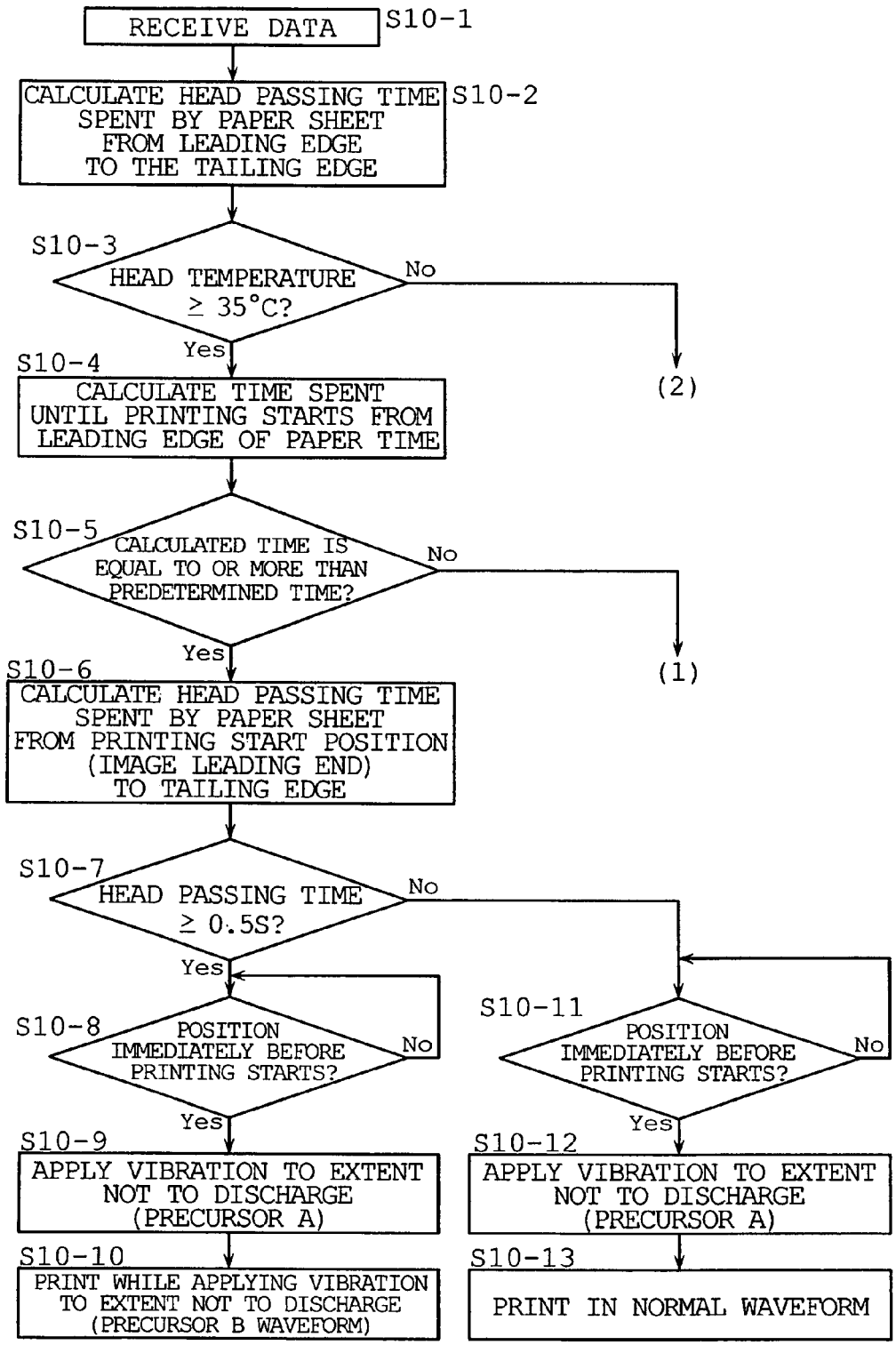
FIG. 10 is a flowchart showing the driving procedure of the ink jet head in the second embodiment.

As shown in FIG. 10, the control part 11 starts the control on receiving various data such as input from a console panel 12, read of the data and program from a storage part 13, a paper size detection signal from a paper size detecting section 14, and a temperature signal from a temperature detecting section 15 (S10-1), and calculates a first head passing time required for the paper sheet P from the leading edge to the tailing edge to pass the ink jet heads 9 (S10-2).

The control part 11 determines whether or not the head temperature is 35° C. or higher (S10-3), and if it is 35° C. or higher (S10-3, YES), the ink deterioration time, which is the reference for determining whether or not the ink deteriorates, is set to 0.5 sec (S10-5, S11-1 mentioned later), and the time (the image formation start time) required for transporting the paper sheet P from the leading edge to the image formation start position of the paper sheet P is calculated (S10-4). The calculation of the image formation start time may be performed by acquiring the positional information about the image data showing an image at the most leading end in the transport direction of the paper sheet P at the stage of image processing for an original document image to be formed.

The control part 11 determines whether or not the calculated image formation start time is 0.5 sec or more (S10-5), and when it is 0.5 sec or more and there is the possibility of ink deterioration (S10-5, YES) before the image formation start, further in order to determine the possibility of ink deterioration after the image formation start, the control part calculates a second head passing time required for the paper sheet P from the image formation start position to the tailing end to pass the ink jet head 9 (S10-6).

The control part 11 determines whether or not the second head passing time is 0.5 sec or more (S10-7). In the case where the calculated second head passing time is 0.5 sec or more (S10-7, YES) and there is a fear of ink deterioration after the image formation start as well, when the position immediately before the image formation start position of the paper sheet P is detected (S10-8, YES), the precursor A is performed (S10-9), and subsequently image formation is performed according to the data in which the data of the precursor B is added to the pixel data (S10-10). That is, while ink is discharged pixel by pixel to perform image formation, in the case where the drop number of ink drops discharged at each pixel is under 5, which is the maximum of discharged drops, the piezoelectric element is driven according to the pixel data to which the data for driving the piezoelectric element not to discharge ink as many times as a difference between five and the drop number of actually discharged ink drops is added, and with the image formation, the precursor B is performed as well.

In the case where the calculated second head passing time is under 0.5 sec (S10-7, NO), and there is no fear of ink deterioration after the image formation start, when the position immediately before the image formation start position is detected (S10-11, YES), the precursor A is performed (S10-12). After that, printing (image formation) is performed in a normal waveform without performing unnecessary precursor microvibration and without causing extra heat generation in the head (S10-13).

Figure 11:
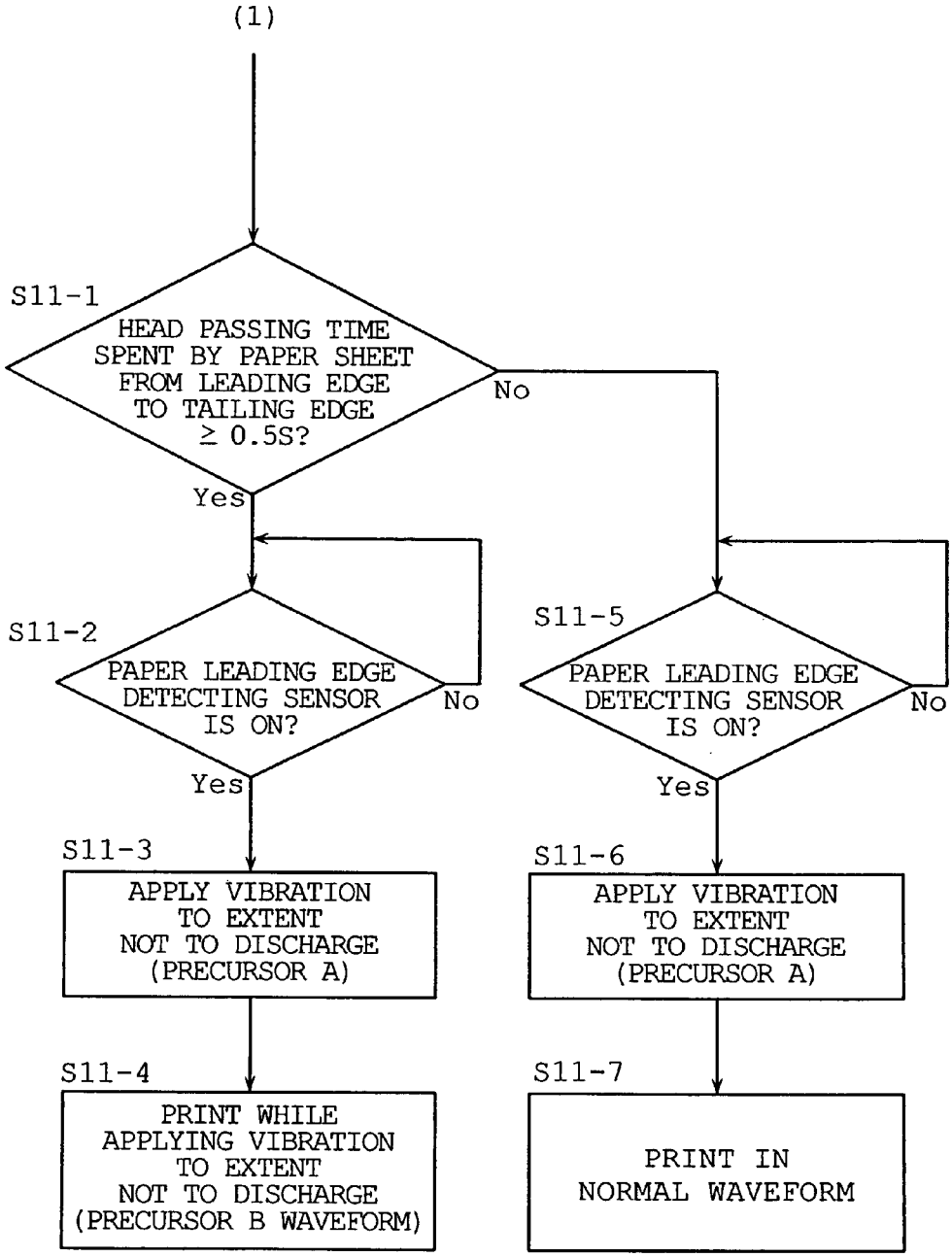
FIG. 11 is a flowchart showing the driving procedure of the ink jet head in the second embodiment.
Figure 12:
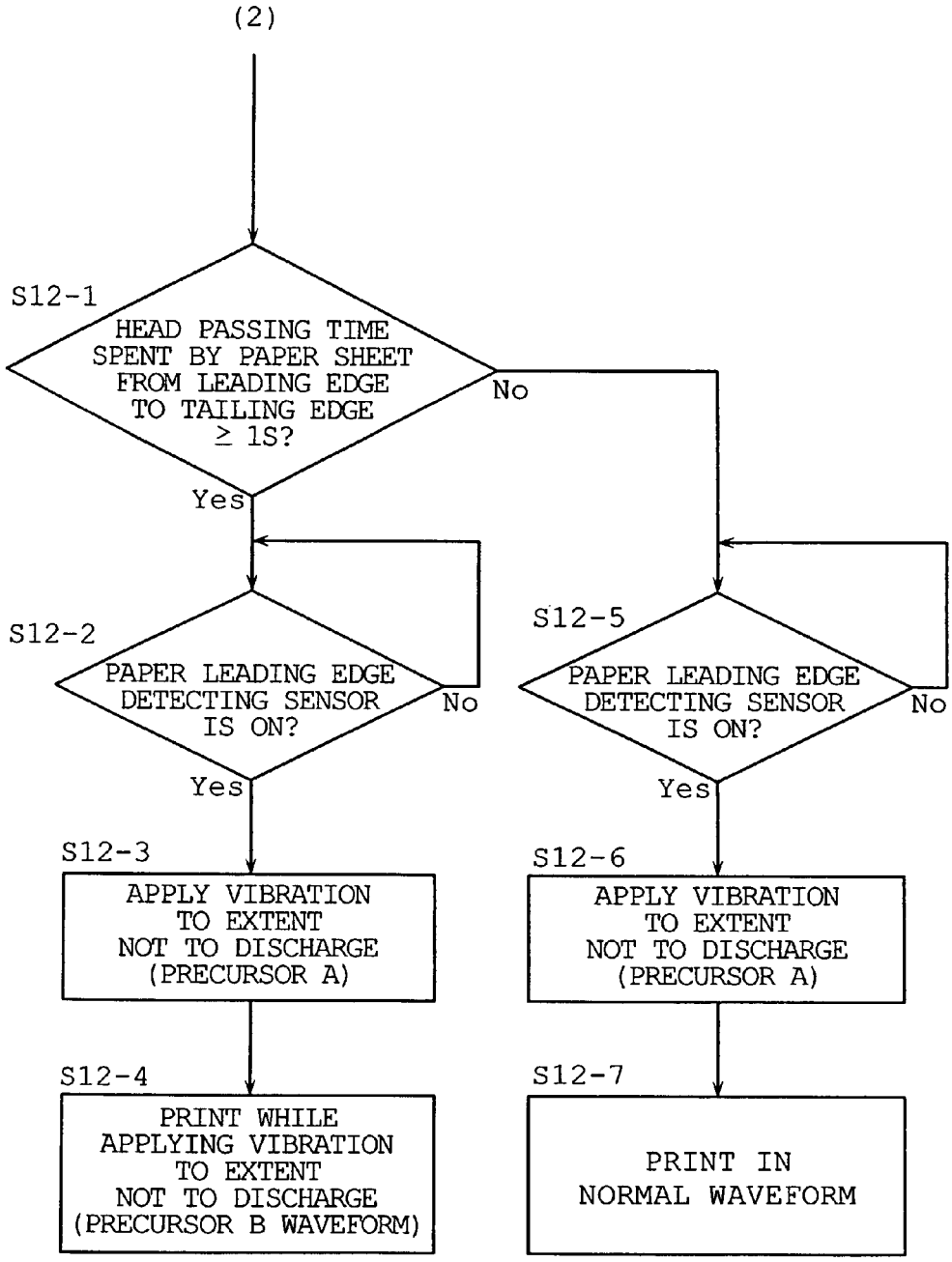
FIG. 12 is a flowchart showing the driving procedure of the ink jet head in the second embodiment.

Subsequently, in the S10-5 of FIG. 10, in the case where the image formation start time is under 0.5 sec (S10-5, NO), as shown in FIG. 11, the control part 11 determines whether or not the first head passing time is 0.5 sec or more (S11-1). In the case where the first head passing time is 0.5 sec or more (S11-1, YES) and there is a fear of ink deterioration, when the leading edge of the paper sheet P is detected by the sensor not shown (S11-2, YES), the precursor A is performed in the timing immediately before the leading edge of the transported paper sheet P (S11-3), and subsequently, similarly to the S10-10 of FIG. 10 described above, image formation is performed according to the image data to which the data of the precursor B is added (S11-4).

In the case where the first head passing time is under 0.5 sec (S11-1, NO) and there is no fear of ink deterioration, when the leading edge of the paper sheet P is detected by the sensor not shown (S11-5, YES), the precursor A is performed in the timing immediately before the leading edge of the transported paper sheet P reaches right under the head (S11-6). After that, printing (image formation) is performed in a normal waveform without performing unnecessary precursor microvibration and without causing extra heat generation in the head (S10-13).

Subsequently, in the S10-3 of FIG. 10, when the head temperature is under 35° C. (S10-3, NO), as shown in FIG. 12, the ink deterioration time, which is the reference for determining whether or not ink deteriorates, is set to one second, and it is determined whether or not the time (the first head passing time) required for transporting the paper sheet P from the leading edge to the tailing edge is one second or longer (S12-1).

In the case where the first head passing time is one sec or more (S12-1, YES), and there is a fear of ink deterioration, when the leading edge of the paper sheet P is detected by the sensor not shown (S12-2, YES), the precursor A is performed in the timing immediately before the leading edge of the transported paper sheet P reaches right under the head (S12-3). Subsequently, similarly to the S10-10 of FIG. 10 described above, image formation is performed according to the image data to which the data of the precursor B is added (S12-4).

In the case where the first head passing time is under one sec (S12-1, NO), and there is no fear of ink deterioration, when the leading edge of the paper sheet P is detected by the sensor not shown (S12-5, YES), the precursor A is performed in the timing immediately before the leading edge of the transported paper sheet P reaches right under the head (S12-6). After that, printing (image formation) is performed in a normal waveform without performing unnecessary precursor microvibration and without causing extra heat generation in the head (S12-7).

3. Third Embodiment

Figure 13:
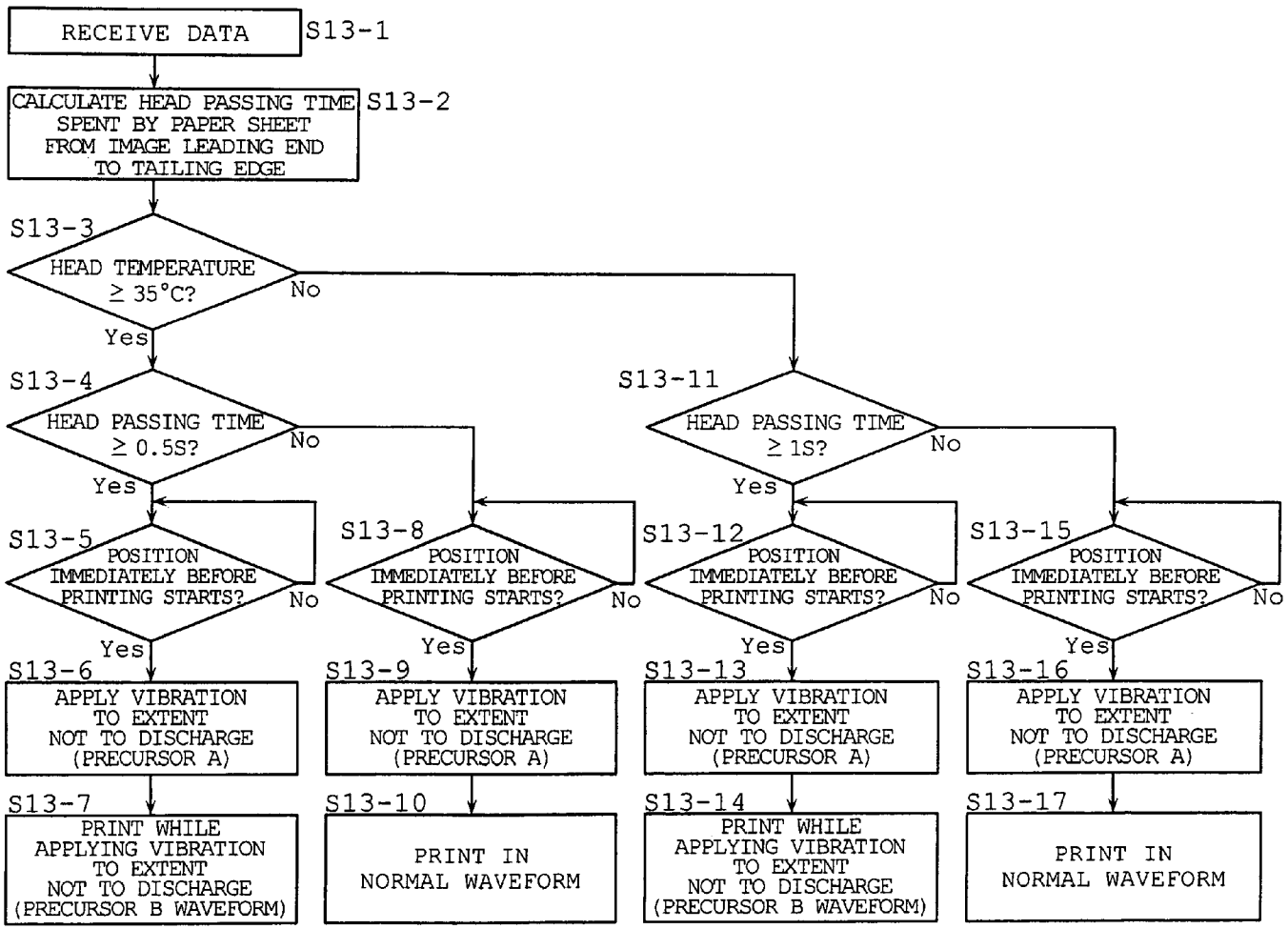
FIG. 13 is a flowchart showing the driving procedure of the ink jet head in the third embodiment.

Third Example, See FIG. 13

An ink jet head 9 in a third embodiment, similarly to the embodiment 2, in the case of printing an original document in which an image G is formed only in the rear part in the transport direction of a paper sheet P and the leading edge side of the paper sheet P is a blank space without being printed, an ink jet heat 9 in a third embodiment does not perform the precursor A differently from the second embodiment, but immediately before the image formation start position, it performs the precursor A at need, and also performs the precursor B at need in the process of image formation. Therefore, the characteristics of the control and operation of the ink jet head 9 in the third embodiment are substantially similar to those of the second embodiment described with reference to FIG. 9. Further, except the control contents, the configuration of the devices is substantially the same as that of the first embodiment.

The control of the ink jet head 9 by a control part 11 or the like in the third embodiment will now be described with reference to a flowchart in FIG. 13.

The control part 11 starts the control on receiving various data such as input from a console panel 12, read of the data and program from a storage part 13, a paper size detection signal from a paper size detecting section 14, and a temperature signal from a temperature detecting section 15 (S13-1), and calculates an image formation start time required for the paper sheet P from the image formation start position to the tailing edge to pass the ink jet heads 9 (S13-2).

The control part 11 determines whether or not the head temperature is 35° C. or higher (S13-3), and if it is 35° C. or higher (S13-3, YES), the ink deterioration time, which is the reference for determining whether or not the ink deteriorates, is set to 0.5 sec, and it is determined whether or not the calculated second head passing time is 0.5 sec or more (S13-4). In the case where the calculated second head passing time is 0.5 sec or more (S13-4, YES) and there is a fear of ink deterioration, when the position immediately before the image formation start position is detected (S13-5, YES), the precursor A is performed in the timing immediately before the image formation start position of the transported paper sheet P reaches right under the head (S13-6), and subsequently image formation is performed according to the image data to which the data of the precursor B is added (S13-7).

In the case where the calculated second head passing time is under 0.5 (S13-4, NO) and there is no fear of ink deterioration, when the position immediately before the image formation start position of the paper sheet P is detected by the sensor not shown (S13-8, YES), the precursor A is performed in the timing immediately before the image formation start position of the transported paper sheet P reaches right under the head (S13-9). After that, printing (image formation) is performed in a normal waveform without performing unnecessary precursor microvibration and without causing extra heat generation in the head (S13-10).

When the head temperature is under 35° C. (S13-3, NO), the ink deterioration time, which is the reference for determining whether or not ink deteriorates, is set longer to one second, and it is determined whether or not the calculated second head passing time is one second or more (S13-11). In the case where the calculated second head passing time is one second or more (S13-11, YES), and there is a fear of ink deterioration, when the position immediately before the image formation start position is detected (S13-12, YES), the precursor A is performed in the timing immediately before the image formation start position of the transported paper sheet P reaches right under the head (S13-13) and subsequently image formation is performed according to the image data to which the data of the precursor B is added (S13-14).

In the case where the calculated second head passing time is under one second (S13-11, NO), and there is no fear of ink deterioration, when the position immediately before the image formation start position of the paper sheet P is detected (S13-15, YES), the precursor A is performed in the timing immediately before the image formation start position of the transported paper sheet P reaches right under the head (S13-16) After that, printing (image formation) is performed in a normal waveform without performing unnecessary precursor microvibration and without causing extra heat generation in the head (S13-17).

In the respective embodiments described above, the ink deterioration time as a measure for the need of precursor microvibration due to ink deterioration with the passage of time is changed depending on the temperature of the ink jet head 9 or its vicinity. To be concrete, one second or 0.5 second is set with 35° C. as the border, but needless to say, this value varies with the type of ink or the structure of the head (especially the nozzle diameter or the like).

What is claimed is:

1. An ink jet head driver, which is adapted to discharge ink drops of a predetermined number and taking a maximum of discharged drops as a limit by each pixel data piece corresponding to a plurality of pixels for constituting an image to a transported paper sheet at desired timing to form the image on the paper sheet in driving an ink jet head including a piezoelectric element for pressurizing ink by displacement of a shear mode and a plurality of nozzles from which the ink is selectively discharged, the ink jet head driver comprising a control section that calculates a first head passing time required for the paper sheet from the leading edge to the tailing edge to pass the ink jet head, drives the piezoelectric element of the ink jet head for a predetermined time to perform precursor microvibration immediately before a leading edge of the paper sheet reaches right under the ink jet head and then drives the piezoelectric element according to the normal pixel data to form the image on the paper sheet when the first head passing time is shorter than deterioration time of the ink, and drives the piezoelectric element of the ink jet head for a predetermined time to perform precursor microvibration immediately before the leading edge of the paper sheet reaches right under the ink jet head and then drives the piezoelectric element according to the pixel data so as not discharge ink as many times as a difference between the maximum of discharged drops and a total number of ink drops to be discharged concerning the pixel in which the number of ink drops to be discharged is under the maximum of discharged drops to form the image on the paper sheet when the first head passing time is equal to or longer than the deterioration time of the ink.

2. The ink jet head driver according to claim 1, wherein the control section calculates an image formation start time required for the paper sheet from the leading edge to the image formation start position to pass the ink jet head, drives the piezoelectric element of the ink jet head to perform precursor microvibration for a predetermined time immediately before the leading edge of the paper sheet reaches right under the ink jet head and then drives the piezoelectric element according to the normal pixel data to form the image on the paper sheet when the image formation start time is shorter than the deterioration time of the ink, calculates a second head passing time required for the paper sheet from the image formation start position to the tailing edge to pass the ink jet head when the image formation start time is equal to or longer than the deterioration time of the ink, drives the piezoelectric element of the ink jet head for a predetermined time to perform precursor microvibration immediately before the image formation position start position of the paper sheet reaches right under the ink jet head and then drives the piezoelectric element according to the normal pixel data to form the image on the paper sheet when the second head passing time is shorter than the deterioration time of the ink, and drives the piezoelectric element of the ink jet head for a predetermined time to perform precursor microvibration immediately before the image formation start position of the paper sheet reaches right under the ink jet head and then drives the piezoelectric element according to the pixel data to which the data for driving the piezoelectric element not to discharge ink as many times as a difference between the maximum number of discharge drops and the number of ink drops to be discharged is added concerning the pixel in which the number of ink drops to be discharged is under the maximum of discharged drops to form the image on the paper sheet when the second head passing time is equal to or longer than the deterioration time of the ink.

3. The ink jet head driver according to claim 2, wherein the second head passing time is determined by a plurality of setting conditions including at least the size of the paper sheet and the transport speed of the paper sheet.

4. The ink jet head driver according to claim 1, wherein the ink jet head driver comprises a temperature detecting section that detects the temperature of the ink jet head, and the control section changes the deterioration time of the ink according to the temperature of the ink jet head detected by the temperature detecting section.

5. The ink jet head driver according to claim 1, wherein the first head passing time is determined by a plurality of setting conditions including at least the size of the paper sheet and the transport speed of the paper sheet.

6. An ink jet head driver, which is adapted to discharge ink drops of a predetermined number and taking a maximum of discharged drops as a limit by each pixel data piece corresponding to a plurality of pixels for constituting an image to a transported paper sheet at desired timing to form the image on the paper sheet in driving an ink jet head including a piezoelectric element for pressurizing ink by displacement of a shear mode and a plurality of nozzles from which the ink is selectively discharged, the ink jet head driver comprising a control section that calculates a second head passing time required for the paper sheet from the image formation start position to the tailing edge to pass the ink jet head, drives the piezoelectric element of the ink jet head for a predetermined time to perform precursor microvibration immediately before the image formation start position of the paper sheet reaches right under the ink jet head and then drives the piezoelectric element according to the normal pixel data to form the image on the paper sheet when the second head passing time is under the deterioration time of the ink, and drives the piezoelectric element of the ink jet head for a predetermined time to perform precursor microvibration immediately before the image formation start position of the paper sheet reaches right under the ink jet head and then drives the piezoelectric element according to the pixel data so as not to discharge ink as many times as a difference between the maximum of discharged drops and a total number of ink drops to be discharged concerning the pixel in which the number of ink drops to be discharged is under the maximum of discharged drops to form the image on the paper sheet when the second head passing time is equal to or longer than the deterioration time of the ink.

* * * * *